US009213300B2

(12) United States Patent
Kashiwakura et al.

(10) Patent No.: US 9,213,300 B2
(45) Date of Patent: Dec. 15, 2015

(54) IMAGE FORMING APPARATUS WITH A CHARGING BIAS SUPPLY CIRCUIT

(71) Applicant: Konica Minolta, Inc., Chiyoda-ku (JP)

(72) Inventors: Kuniaki Kashiwakura, Toyohashi (JP); Noritoshi Hagimoto, Toyohashi (JP); Hokuto Hatano, Hachioji (JP); Eri Kusano, Toyokawa (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 82 days.

(21) Appl. No.: 14/046,189

(22) Filed: Oct. 4, 2013

(65) Prior Publication Data

US 2014/0099132 A1 Apr. 10, 2014

(30) Foreign Application Priority Data

Oct. 5, 2012 (JP) ..... 2012-222624

(51) Int. Cl.
*G03G 15/02* (2006.01)
*G03G 21/00* (2006.01)

(52) U.S. Cl.
CPC ..... *G03G 21/0094* (2013.01)

(58) Field of Classification Search
CPC ..... G03G 21/0094
USPC ..... 399/50, 128
See application file for complete search history.

(56) References Cited

U.S. PATENT DOCUMENTS

2011/0058834 A1 3/2011 Inami et al.
2012/0230710 A1* 9/2012 Gomi ..... 399/50

FOREIGN PATENT DOCUMENTS

| | | | |
|---|---|---|---|
| JP | 05-232784 | | 9/1993 |
| JP | 2002-116663 | | 4/2002 |
| JP | 2004-212623 | A | 7/2004 |
| JP | 2005-266353 | | 9/2005 |
| JP | 2006-099054 | | 4/2006 |
| JP | 2006-126530 | A | 5/2006 |
| JP | 2006-189501 | | 7/2006 |
| JP | 2009-031628 | A | 2/2009 |
| JP | 2011-059218 | | 3/2011 |
| JP | 2011-209490 | A | 10/2011 |

OTHER PUBLICATIONS

Notification of Reasons for Rejection issued in corresponding Japanese Patent Application No. 2012-222624, dated Oct. 21, 2014 and English Translation.

* cited by examiner

*Primary Examiner* — Walter L Lindsay, Jr.
*Assistant Examiner* — Ruth Labombard
(74) *Attorney, Agent, or Firm* — Buchanan Ingersoll & Rooney PC

(57) ABSTRACT

In an image forming apparatus, the charging bias supply circuit generates a second charging bias voltage that causes no positive discharge between the charging unit and the photoreceptor drum, during a recovery mode, the charging unit charges the surface of the photoreceptor drum upon application of the second charging bias voltage during the recovery mode, and the cleaning unit rubs the surface of the photoreceptor drum charged by the second charging bias voltage, during the recovery mode.

7 Claims, 6 Drawing Sheets

IMAGE FORMING APPARATUS WITH A CHARGING BIAS SUPPLY CIRCUIT

This application is based on Japanese Patent Application No. 2012-222624 filed on Oct. 5, 2012, the content of which is incorporated herein by reference.

BACKGROUND OF THE INVENTION

1. Field of the Invention

The present invention relates to electrophotographic image forming apparatuses, more particularly to an image forming apparatus in which photoreceptor drums are electrically charged by charging units using proximity discharge.

2. Description of Related Art

Recently, to achieve a low cost per print (CPP), image forming apparatuses have been researched and developed so as to have a longer service life. Such research and development activities often target a longer service life of photoreceptor drums. For example, some photoreceptor drums have protective layers provided on their surfaces. The protective layer renders the surface of the photoreceptor drum less wearable and less polishable.

Furthermore, the electrophotographic image forming apparatus might have an image defect called image deletion. Image deletion is said to occur when the surface of the photoreceptor drum is rendered less resistant due to adhesion of a discharge product, so that latent image charges flow in the sub-scanning direction of the photoreceptor drum.

To prevent image deletion, the image forming apparatus under the circumstances in which image deletion is likely to occur (e.g., a high-temperature, high-humidity environment) executes a recovery mode to remove a portion of the photoreceptor drum surface that is less resistant (hereinafter, such a portion will be simply referred to as a "low-resistance portion) (see Japanese Patent Laid-Open Publication Nos. 2004-212623 and 2011-209490).

In Japanese Patent Laid-Open Publication No. 2004-212623, the recovery mode changes the output of an alternating-current component of the voltage applied to a charging unit (e.g., a charging roller) using proximity discharge. As a result, the photoreceptor drum is rendered more wearable, so that the low-resistance portion can be removed.

In Japanese Patent Laid-Open Publication No. 2011-209490, prior to cleaning of the photoreceptor drum, the current flowing through a charging unit (e.g., a charging roller) using proximity discharge is measured when a measurement voltage is applied to the charging unit. The amount of toner to be supplied during cleaning is set on the basis of the measurement result. Thereafter, development is performed with the amount of toner being set, and the toner supported on the surface of the photoreceptor drum is carried to a cleaning blade. As a result, the abrasive performance of the blade is enhanced, so that the low-resistance portion is removed.

However, the photoreceptor drum surface with a protective layer provided thereon has a problem in that it is difficult to remove the low-resistance portion from the surface even if the recovery mode is executed.

SUMMARY OF THE INVENTION

An image forming apparatus according to an embodiment of the present invention includes: a photoreceptor drum having a protective layer formed on its surface; a charging bias supply circuit configured to generate a first charging bias voltage at the time of printing; a charging unit configured to, upon application of the first charging bias voltage, cause a proximity discharge, including a positive discharge and a negative discharge, between the surface of the photoreceptor drum and the charging unit, thereby charging the surface; a scanning optical system configured to irradiate the surface of the photoreceptor drum with an optical beam, thereby forming an electrostatic latent image, at the time of printing; a developing unit configured to develop the electrostatic latent image formed on the photoreceptor drum, at the time of printing; and a cleaning unit configured to rub the surface of the photoreceptor drum charged by the charging unit, at the time of printing, in which, the charging bias supply circuit is configured to generate a second charging bias voltage that causes no positive discharge between the charging unit and the photoreceptor drum, during a recovery mode, the charging unit is configured to charge the surface of the photoreceptor drum upon application of the second charging bias voltage during the recovery mode, and the cleaning unit is configured to rub the surface of the photoreceptor drum charged by the second charging bias voltage, during the recovery mode.

DETAILED DESCRIPTION OF THE PREFERRED EMBODIMENTS

Preliminary Note

Figure 1:
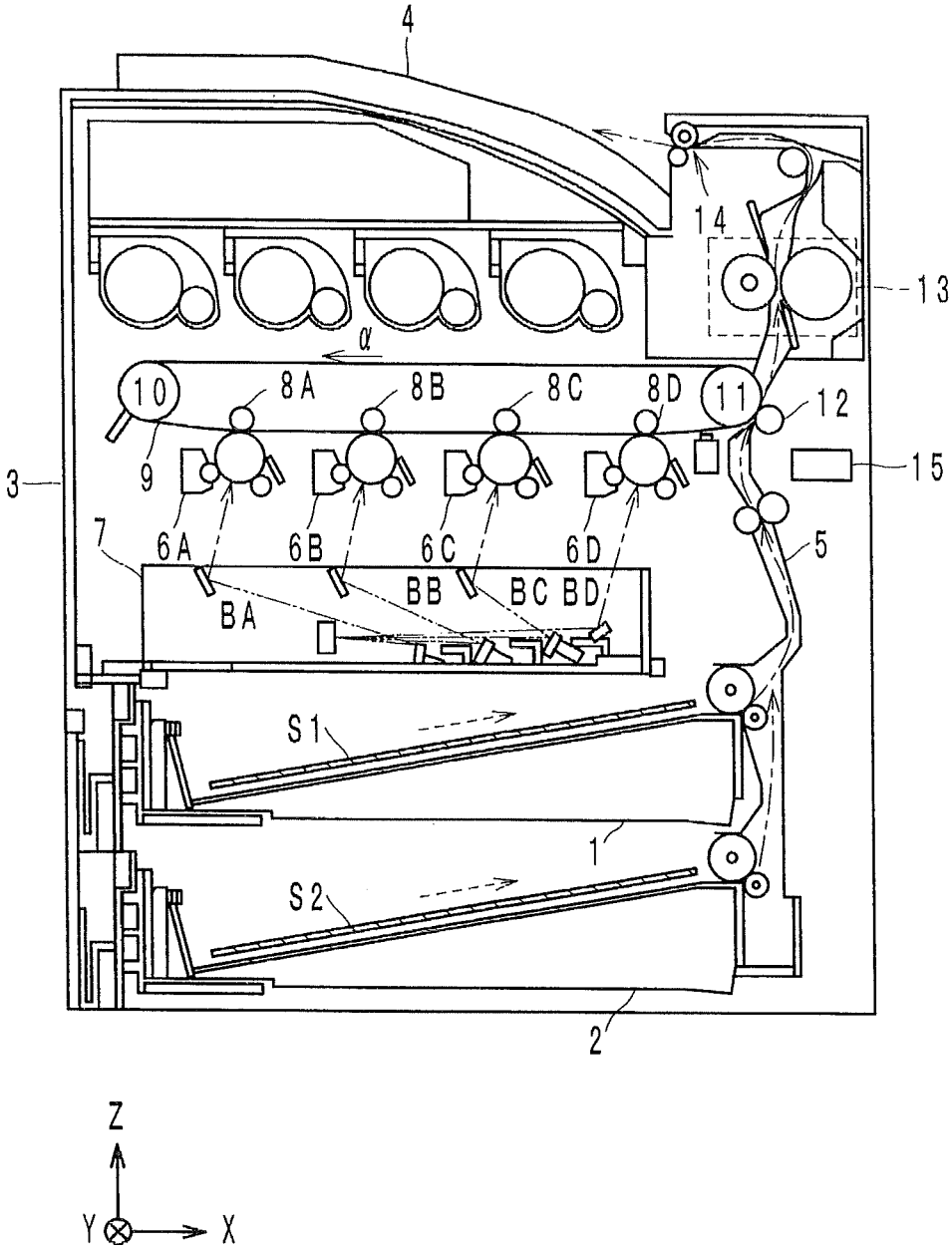
FIG. 1 is a schematic view illustrating the configuration of an image forming apparatus according to an embodiment of the present invention.

Before describing the image forming apparatus according to an embodiment of the present invention, some terminological definitions will be given first. In some figures, X-, Y-, and Z-axes are shown. The X-, Y-, and, Z-axes represent the left-right (width) direction, the front-back (depth) direction, and the top-bottom (height) direction, respectively, of the image forming apparatus. Moreover, in the figures, for some components, the suffix A, B, C, or D is assigned at the ends of their reference numerals. The suffixes A, B, C, and D represent yellow (Y), magenta (M), cyan (C), and black (Bk), respectively. For example, an imaging unit 6A refers to an imaging unit 6 for yellow. Moreover, in the case where none of the suffixes is assigned to a reference numeral which can be assigned any one of the suffixes, the reference numeral is intended for collective reference to all colors. For example, an imaging unit 6 is intended to mean an imaging unit 6A, 6B, 6C, or 6D for any one of the colors Y, M, C, and Bk.

Configuration and Printing Operation of Image Forming Apparatus

First, the configuration and the printing operation of the image forming apparatus will be described with reference to FIGS. 1 to 3. In FIG. 1, the image forming apparatus is an electrophotographic multifunction peripheral (MFP), and generally includes two supply cassette 1 and 2, a main unit 3, and an output tray 4.

The supply cassettes 1 and 2 are disposed at the bottom of the image forming apparatus. The cassettes 1 and 2 have unprinted recording media S1 and S2 (e.g., sheets of paper) stacked therein. The recording media S1 and S2 stacked in the cassettes 1 and 2 are picked up one by one from the top and fed toward a transportation path 5 by action of rotating supply rollers and other components. Note that, of the cassettes 1 and 2, only the cassette 1 will be described below for convenience of explanation.

The main unit 3 is disposed above the cassette 1. The main unit 3 has the transportation path 5 formed at the right, as indicated by a long dashed short dashed line. The recording medium S1 fed from the cassette 1 is introduced into the transportation path 5. The recording medium S1 is transported through the transportation path 5 toward the output tray 4.

Furthermore, the main unit 3 forms an image on the recording medium S1 being transported through the transportation path 5, thereby producing a print. More specifically, the main unit 3 employs a so-called tandem system in order to support full-color printing, and includes four imaging units 6A to 6D. The main unit 3 also includes a scanning optical system 7, primary transfer rollers 8A to 8D, an intermediate transfer belt 9, rollers 10 and 11, a secondary transfer roller 12, a fusing unit 13, an ejection roller pair 14, and a control circuit 15 for controlling various components.

Figure 2A:
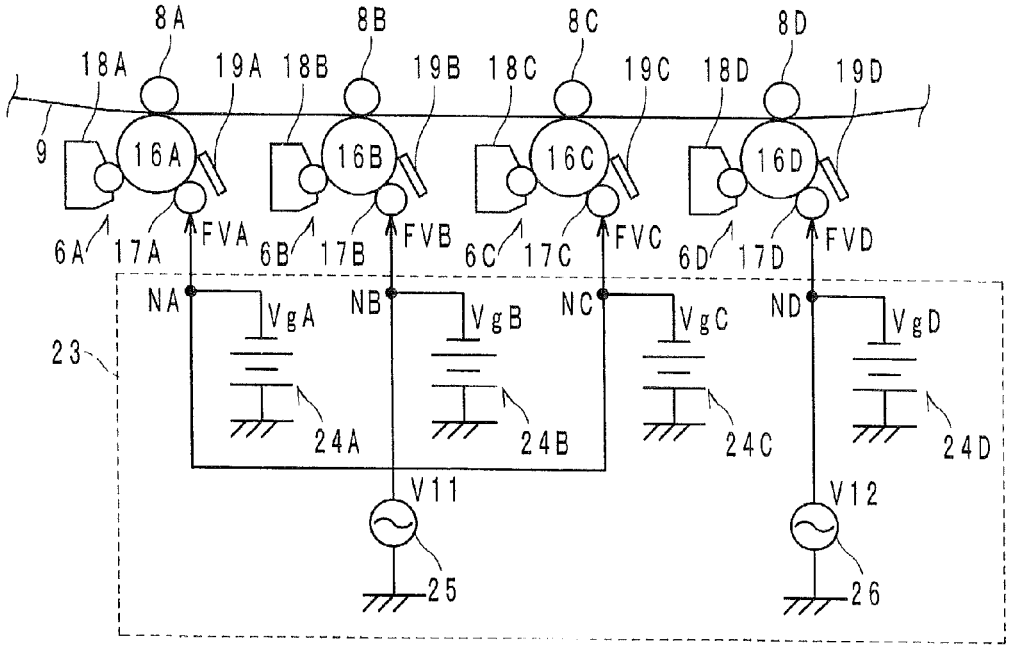
FIG. 2A is a diagram illustrating a general configuration of a charging bias supply circuit shown in FIG. 1.
Figure 2B:
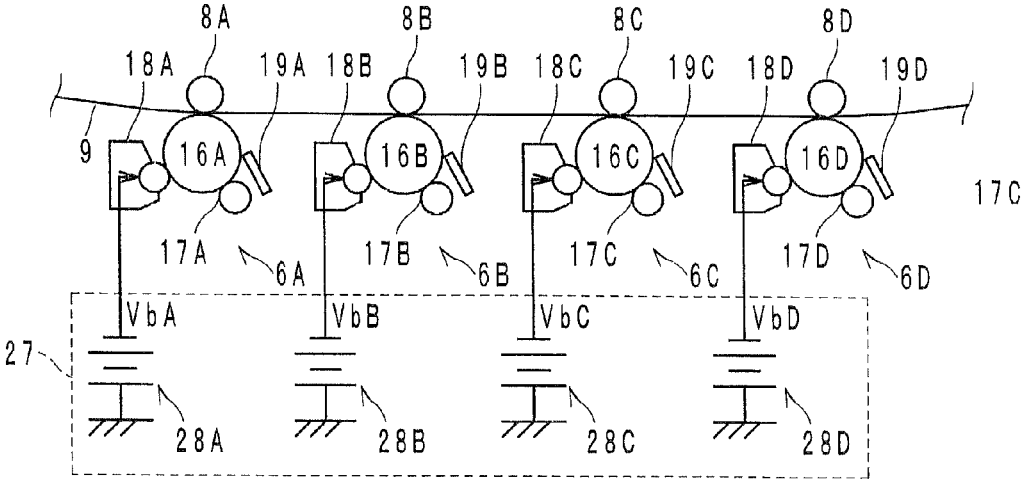
FIG. 2B is a diagram illustrating a general configuration of a developing bias power circuit shown in FIG. 1.

The imaging units 6A to 6D are arranged side by side. In the example shown in the figures, the imaging unit 6A is disposed horizontally furthest from the transportation path 5, and the other imaging units are positioned in the following order, from furthest to closest to the transportation path 5: 6B, 6C, and 6D. Furthermore, each imaging unit 6 has a photoreceptor drum 16, a charging unit 17, a developing unit 18, and a cleaning unit 19, as shown in FIGS. 2A and 2B, and other figures.

Figure 3:
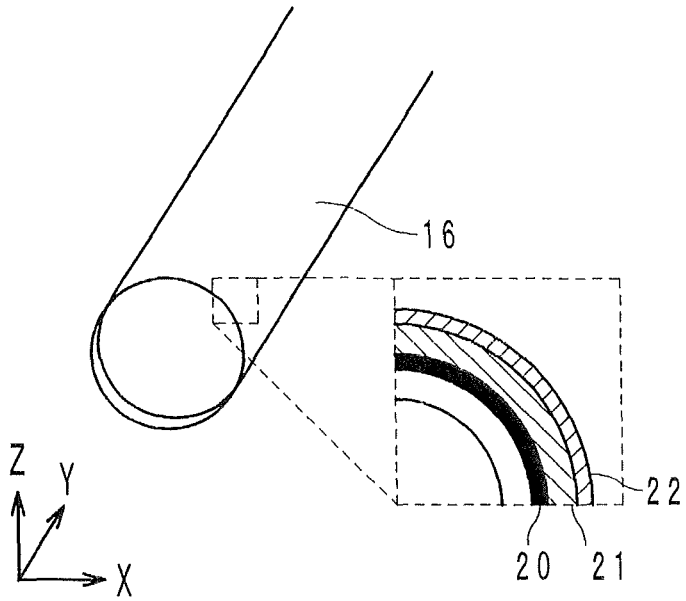
FIG. 3 is a diagram illustrating in detail the structure of a photoreceptor drum shown in FIG. 2A.

The photoreceptor drum 16 extends in the depth direction of the image forming apparatus, and includes an organic photoreceptor obtained by laminating a charge generating layer (referred to below as a CGL) 20, a charge transporting layer (referred to below as a CTL) 21, and a protective overcoating layer (referred to below as an OCL) 22 in this order, as illustrated in FIG. 3.

In an electrophotographic process, a toner image formed on the surface of the photoreceptor drum might be transferred onto the intermediate transfer belt. Thereafter, to remove the remaining toner on the surface, the cleaning unit rubs the surface. Here, if the surface (uppermost layer) of the photoreceptor drum is a CTL, the CTL is worn through the rubbing by the cleaning unit. To prevent this, the photoreceptor drum 16 of the present embodiment has the OCL 22 formed on the surface.

Cross-linkable resin, which is formed of a particulate metal oxide composition treated with a surface-treatment agent, is used as the OCL 22. The surface-treatment agent to be used has an acrylic polymerizable compound and a polymerizable functional group. Moreover, the acrylic polymerizable compound to be used is, for example, a chain polymerizable compound with prescribed monomers, either an acryloyl group ($CH_2{=}CHCO{-}$) or a methacryloyl group ($CH_2{=}CCH_3CO{-}$). The prescribed monomers are those capable of forming resin to be used as binder resin when they are polymerized (cured) by irradiation with an active ray such as an ultraviolet ray or an electron ray. Moreover, for example, a tin oxide is used as the particulate metal oxide. The particulate metal oxide is surface-treated with a compound having a radical polymerizable functional group (see (1) below).

$$CH_2{=}C(CH_3)COO(CH_2)_3Si(OCH_3)_3 \quad (1)$$

Next, the method for producing the OCL 22 will be described. First, an OCL 22 (a composition containing a surface-treated particulate metal oxide or suchlike) is applied in liquid form to a CTL 21. This applied coating is dried until its fluidity is reduced to a certain degree (primary drying). After primary drying, the applied coating is irradiated with an ultraviolet ray or suchlike, so that the OCL 22 is cured. To set the amount of volatile substance in the applied coating within a defined range, the applied coating is further dried (secondary drying). In this manner, the OCL 22 is formed. Note that, for example, a known device for curing ultraviolet-curable resin is used for ultraviolet irradiation.

FIG. 2A will be referenced again. The charging units 17 are of the type that uses proximity discharge. The charging units 17 of this type typically include charging rollers disposed in contact with the photoreceptor drums 16. However, the charging units 17 may include non-contact type charging rollers, brushes, or the like, in place of the contact-type charging rollers, so long as they use proximity discharge.

The charging roller included in each charging unit 17 extends parallel to the photoreceptor drum 16 for its corresponding color. More specifically, the charging roller is in contact with or in the proximity of the circumferential surface of the photoreceptor drum 16 for the corresponding color. A first charging bias voltage FV, which is generated by a charging bias supply circuit 23, is applied to the charging roller.

The supply circuit 23 will now be described. The supply circuit 23 includes direct-current power circuits 24A to 24D, an alternating-current power circuit 25 common for a plurality of colors (e.g., the three colors of Y, M, and C), and an alternating-current power circuit 26 for the remaining color (e.g., Bk).

The direct-current power circuits 24A to 24D, under control of the control circuit 15, output direct voltages VgA to VgD with variable potentials. The direct voltages VgA to VgD are adjusted for their respective colors by stabilization control in a well-known manner. Therefore, the direct-current power circuits 24A to 24D are provided independently of each other, for their respective colors.

Furthermore, the alternating-current power circuits 25 and 26 are, for example, alternating-current transformers, which, under control of the control circuit 15, output alternating voltages V11 and V12 with variable peak-to-peak voltage values. Unlike the direct-current power circuit 24, the alternating-current power circuit 25 is shared among a plurality of colors (Y, M, and C) from the viewpoint of cost reduction. Moreover, in the present embodiment, for monochrome image formation, the alternating-current power circuit 26 for Bk is provided independently of the alternating-current power circuit 25.

The alternating-current power circuit 25 is connected at an output terminal to output terminals of the direct-current power circuits 24A to 24C at nodes NA to NC. At the nodes NA to NC, the alternating voltage V11 is superimposed on the direct voltages VgA to VgC, whereby first charging bias voltages FVA to FVC are generated. The first charging bias voltages FVA to FVC are applied to the charging rollers of the charging units 17A to 17C.

Furthermore, the alternating-current power circuit 26 is connected at an output terminal to an output terminal of the direct-current power circuit 24D at a node ND. At the node ND, the alternating voltage V12 is superimposed on the direct voltage VgD, whereby a first charging bias voltage FVD is generated. The first charging bias voltage FVD is applied to the charging roller of the charging unit 17D.

Here, at the time of the generation of the first charging bias voltage FV, the alternating voltages V11 and V12 have about twice the peak-to-peak voltage value (Vpp) for the voltage at which to start charging the photoreceptor drum 16 by direct voltage application (i.e., the direct voltage applied to the charging roller and raised to a level at which its potential is applied to the surface of the photoreceptor drum 16). By using such alternating voltages V11 and V12, a negative discharge and a positive discharge are caused to alternatingly occur between the charging roller and the surface of the photoreceptor drum 16, so that the potential of the charged photoreceptor drum 16 is saturated at the value of the direct voltage Vg. As a result, the surface of the photoreceptor drum 16 is uniformly charged.

FIG. 1 will be referenced again. The scanning optical system 7 generates optical beams BA to BD modulated on the basis of image data. Thereafter, the scanning optical system 7 irradiates the surfaces of the charged photoreceptor drums 16A to 16D with the generated optical beams BA to BD, thereby forming electrostatic latent images on the surfaces.

FIG. 2B will now be referenced. Each developing unit 18 includes a developing roller. The developing roller is disposed so as to extend parallel to the photoreceptor drum 16 between the irradiation position on the surface of the photoreceptor drum 16 and the primary transfer roller 8. A developing bias voltage Vb, which is generated by a developing bias power circuit 27, is applied to the developing roller. Moreover, the developing unit 18 is supplied with toner from a toner storage unit for its corresponding color. The developing unit 18 uses the developing roller to supply toner to the surface of the photoreceptor drum 16, thereby developing the electrostatic latent image formed on the surface. As a result, a toner image in the corresponding color is formed on the surface of the photoreceptor drum 16.

Next, the power circuit 27 will be described. The power circuit 27 includes direct-current power circuits 28A to 28D for their respective colors. The direct-current power circuits 28A to 28D, under control of the control circuit 15, output developing bias voltages VbA to VbD with variable potentials.

Here, FIG. 1 will be referenced again. The intermediate transfer belt 9 is stretched around rollers, including the rollers 10 and 11, in a looped form, such that the back surface of the intermediate transfer belt 9 contacts the surfaces of the photoreceptor drums 16. The intermediate transfer belt 9 is caused to rotate in the direction of arrow α by the rollers 10 and 11 being rotated by drive forces provided from unillustrated motors.

Each primary transfer roller 8 is disposed so as to be opposed to the surface of the photoreceptor drum 16 for its corresponding color with respect to the intermediate transfer belt 9. The primary transfer roller 8 transfers the toner image supported on the photoreceptor drum 16 for the corresponding color, onto the intermediate transfer belt 9 rotating in the direction of arrow α, approximately at the same position (primary transfer). As a result, the toner images in their respective colors are superimposed on one after another, thereby generating a composite toner image on the surface of the intermediate transfer belt 9. Moreover, the composite toner image is carried on the intermediate transfer belt 9 to the position of a transfer nip (to be described later).

Furthermore, the secondary transfer roller 12 is disposed so as to be opposed to the roller 11 with respect to the intermediate transfer belt 9. The secondary transfer roller 12 is in contact with the intermediate transfer belt 9, so that a transfer nip is formed therebetween. A recording medium S1 is introduced from the cassette 1 to the transportation path 5, and forwarded to the transfer nip. In addition, the secondary transfer roller 12 has a transfer bias voltage applied thereto, so that the composite toner image is drawn to the secondary transfer roller 12 by the transfer bias voltage, and transferred onto the recording medium S1 introduced in the transfer nip (secondary transfer). The recording medium S1 subjected to secondary transfer is fed from the transfer nip toward the fusing unit 13.

The fusing unit 13 heats and presses the recording medium S1 fed from the transfer nip, thereby fixing the composite toner image onto the recording medium S1. The recording medium S1 subjected to the fixing process is ejected into the output tray 4 by the ejection roller pair 14 as a print.

Recovery Mode

Figure 4:
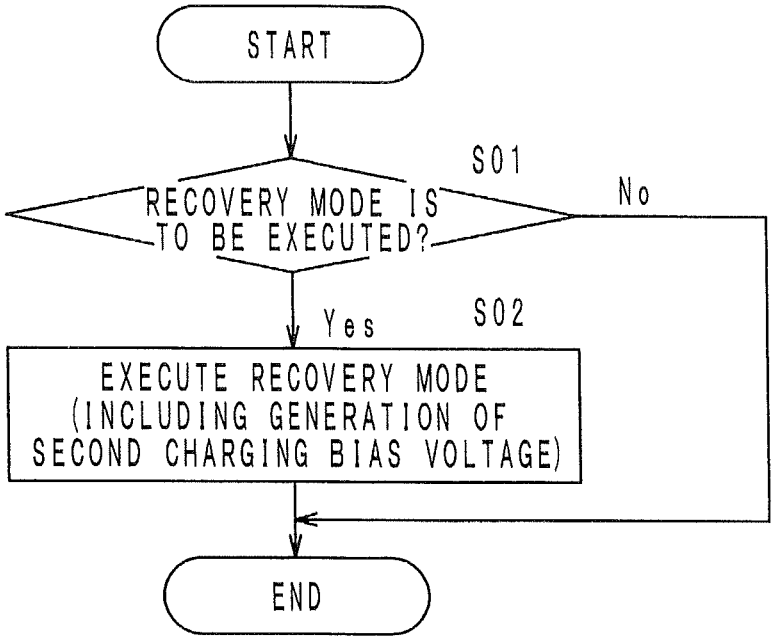
FIG. 4 is a flowchart showing the procedure of a recovery mode.

Next, referring to FIG. 4, the procedure of the recovery mode of the image forming apparatus will be described. In the image forming apparatus, the control circuit 15 determines whether or not to execute the recovery mode (S01). Although the determination method of S01 is well-known, and up until now, there have been proposed a number of similar determination methods, one example of the method will be given for reference. In this example, the control circuit 15 makes a determination of "Yes" in S01 when outputs (temperature and humidity) from temperature and humidity sensors provided in the image forming apparatus exceed predetermined reference values.

Next, the control circuit 15 performs the recovery mode (S02). In S02, the following components operate under control of the control circuit 15. First, the photoreceptor drums 16 start rotating. Then, the charging bias supply circuit 23 generates second charging bias voltages SVA to SVD (the details of which will be described later). The charging units 17 charge the photoreceptor drums 16 for their corresponding colors when the second charging bias voltages SVA to SVD for the corresponding colors are applied to the charging rollers of the charging units 17. Moreover, the developing bias power circuit 27 generates developing bias voltages Vb described above, and applies the developing bias voltages Vb to the developing units 18 for their corresponding colors. However, from the viewpoint of achieving a low CPP, it is preferable for the developing units 18 not to supply toner to the photoreceptor drums 16. Further, the cleaning units 19 rub the surfaces of the photoreceptor drums 16, which are rotating while being charged by the second charging bias voltages SV, so that low-resistance portions are removed from the surfaces.

Figure 5:
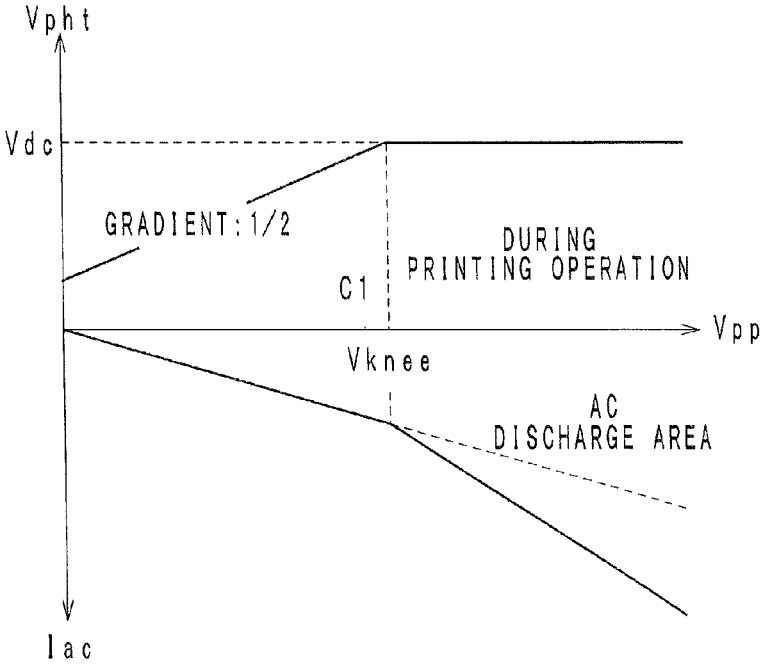
FIG. 5 is a graph showing, by way of specific example, a surface potential of the photoreceptor drum and alternating current (effective value) flowing through a charging roller versus an alternating voltage (peak-to-peak voltage value) applied to the charging roller.

Surface Potential and Electrification Current Versus Applied Alternating Voltage Next, referring to FIG. 5, the surface potential Vpht of the photoreceptor drum 16 and alternating current Iac (effective value) flowing through the charging roller versus the alternating voltage (peak-to-peak voltage value Vpp) applied to the charging roller of the charging unit 17 will be described. In FIG. 5, the X-axis represents Vpp, and the Y-axis represents Vpht (negative potentials only) at the upper portion and Iac at the lower portion.

Here, it is assumed that the direct-current power circuit 24 and the alternating-current power circuits 25 and 26 shown in FIG. 2 are controlled at constant voltages. The direct voltages VgA to VgD are assumed to be substantially fixed at Vdc. FIG. 5 shows Vpht and Iac where the peak-to-peak voltage value Vpp for the alternating voltages V11 and V12 is changed under the above conditions.

As the peak-to-peak voltage value Vpp increases, the surface potential Vpht rises approximately with a gradient of ½, and is saturated and fixed at Vdc. The value Vpp at the start of saturation (i.e., the minimum of the value Vpp upon saturation) will be defined as Vknee. The value Vknee is about twice the value of the voltage Vth at which to start charging the photoreceptor drum 16 by direct voltage application (i.e., the direct voltage applied to the charging roller and raised to a level at which its potential is applied to the surface of the photoreceptor drum 16), and the value Vknee is mainly dependent on the film thickness of the photoreceptor drum 16. Specifically, the voltage Vth is approximately 500V to 600V, and therefore the value Vknee is approximately 1000V to 1200V.

Furthermore, the alternating current Iac rises from a zero point in proportion to Vpp, and increases up to Vknee with a constant gradient. In the range exceeding Vknee, Iac increases with a gradient which is constant but higher than the gradient up to Vknee. The reason for this is that no positive discharge from the charging roller occurs in the range up to Vknee (i.e., in the range where Vpht is less than or equal to Vdc) but a positive discharge occurs in the range exceeding Vknee (in the figure, AC discharge area).

Upon execution of printing, the alternating voltages V11 and V12 are required to be set to values that stabilize the value of Vpht within the predictable range. Even in the range below Vknee, the value of Vpht can be approximately predictable, but in this range, no positive discharge occurs, so that the diselectrifying function is not active, resulting in an unstable surface potential Vpht. Accordingly, there is a possibility where the surface potential Vpht of the photoreceptor drum 16 might not be uniform across the entire surface. When the surface potential Vpht is not uniform, image noise appears on a print. Therefore, upon execution of printing, it is preferable that the alternating voltages V11 and V12 with values at least greater than Vknee be applied to the charging rollers.

However, the actual charging unit 17 is positioned lengthwise in the depth direction of the image forming apparatus, and furthermore, the force of the charging roller pressing the surface of the photoreceptor drum 16 and the nip widths of the charging roller and the photoreceptor drum 16 vary in the longitudinal direction. Accordingly, even when the alternating voltages V11 and V12 are greater than or equal to Vknee, if they are relatively small values, the value of Vpht might be unstable in the longitudinal direction. Therefore, upon execution of printing, it is further preferable that the alternating voltages V11 and V12 exceed Vknee+α. Here, α is a design margin. Note that if α is excessively high, current discharged from the photoreceptor drum 16 increases, leading to increased attrition of the photoreceptor drum 16. Moreover, in the case of the photoreceptor drum 16 resistant to attrition, if α is set excessively high, image deletion might occur.

Some conceivable reasons why a positive discharge increases attrition and causes image deletion are as follows. Specifically, the photoreceptor drum 16 used is of such a type that its photosensitivity increases when there is a negative charge on the surface of the photoreceptor drum 16. The reason for this is that the CTL 21 (see FIG. 3) is made of a material that only allows a positive charge to move. That is, when there is a negative charge on the surface, the charge can be cancelled by an erasing beam. However, when there is a positive charge on the surface, the charge cannot be cancelled by an erasing beam. To cancel the positive charge, it is necessary to provide a negative charge on the surface of the photoreceptor drum 16. However, providing a negative charge means occurrence of excess discharge on the surface of the photoreceptor drum 16. Such excess discharge accelerates deterioration of the surface. Note that the positive charge is provided, not only by the charging roller but also by the primary transfer roller 8 (see FIG. 2A), and therefore, the primary transfer voltage causes deterioration of the photoreceptor drum 16 as well.

Alternating Voltage Superimposed on Second Charging Bias

Figure 6:
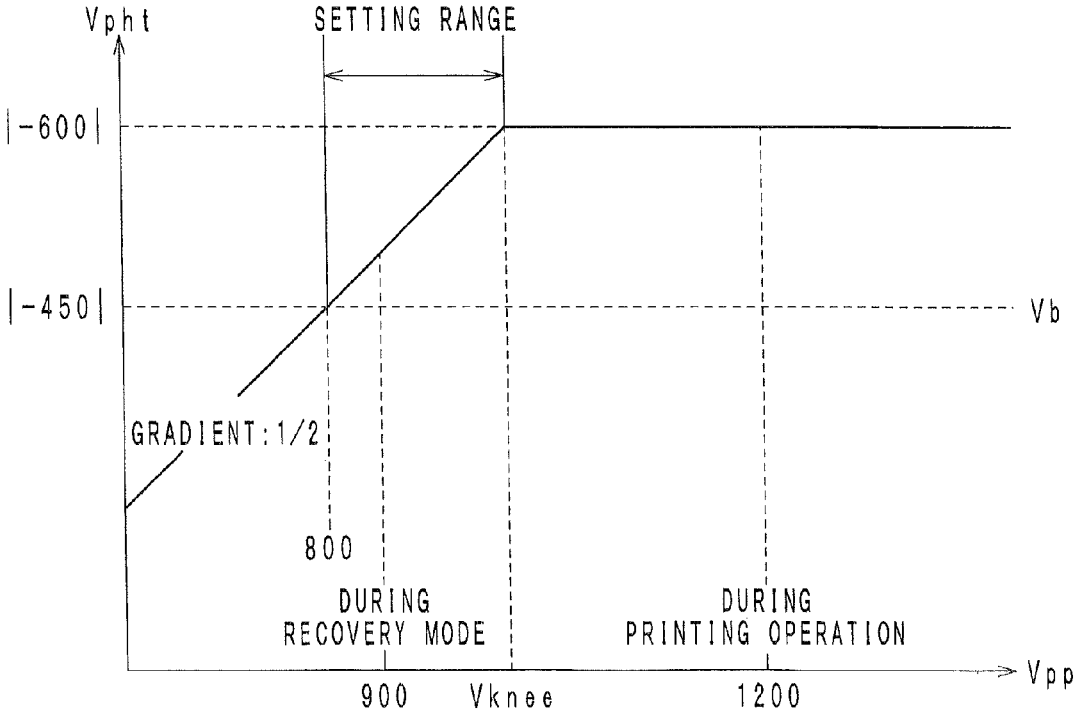
FIG. 6 is a graph showing the setting range of an alternating voltage applied to the charging roller during the recovery mode.

Next, referring to FIG. 6, the setting range of an alternating voltage to be superimposed to generate the second charging bias voltage SV (i.e., an alternating voltage applied to the charging roller in the recovery mode) will be described. In FIG. 6, the value of Vknee at which the potential of the photoreceptor drum 16 is saturated at Vdc is 1100V, but given a margin, the peak-to-peak voltage value Vpp (i.e., Vknee) for the alternating voltages V11 and V12 is controlled to be at 1200V during execution of printing. Moreover, the direct voltage Vg (i.e., Vdc) is set to −600V, and the developing bias voltage Vb is set to −450V.

If Vpp is set to 1200V for the recovery mode, the positive discharge causes deterioration of the photoreceptor drum 16 to progress even during the recovery mode. If toner is supplied to the surface of the photoreceptor drum 16 as in execution of printing, the polishing action of the toner can prevent the surface of the photoreceptor drum 16 from deteriorating. However, if toner is used during the recovery mode, the cost to be spent on toner increases, resulting in a failure to achieve a low CPP. Therefore, in the recovery mode, the peak-to-peak voltage value Vpp for the alternating voltages V11 and V12 is set to a value (e.g., 900V) less than or equal to Vknee at which no positive discharge occurs. As a result, it is possible to inhibit surface deterioration of the photoreceptor drum 16 from progressing during the recovery mode.

Furthermore, in the case where Vpp is set to 800V or less, the absolute value of the direct voltage Vg is |−600|V, and since the gradient of the surface potential Vpht is ½, the surface potential Vpht falls bellow the absolute value of the developing bias voltage Vb, which is |−450|V. In this situation, when the absolute values are compared, the surface potential of the photoreceptor drum 16 is less than the potential of the developing bias voltage. In this case, negative toner moves from the developing unit 18 to the surface of the photoreceptor drum 16 and adheres thereto. Accordingly, when Vpp is set to 800V or less, a low CPP might not be achievable. Therefore, it is further preferable for Vpp to have an absolute value greater than 800V but not exceeding 1100V.

To comprehensively describe the foregoing, the peak-to-peak voltage value Vpp is preferably such that $|Vknee-2\cdot(|Vg|-|Vb|)|<Vpp\leq|Vknee|$.

Effects

Next, the technical advantages of the image forming apparatus will be described with reference to Table 1. Table 1 shows the ranking for image deletion among operation hours in the recovery mode where the peak-to-peak voltage value Vpp for the alternating voltages V11 and V12 was changed during execution of the recovery mode in a high-temperature, high-humidity environment (temperature: 30° C., relative humidity: 85%).

TABLE 1

| Vpp<br>Vpht | | 700<br>400 | 800<br>450 | 900<br>500 | 1000<br>550 | 1100<br>600 | 1200<br>600 | 1300<br>600 |
|---|---|---|---|---|---|---|---|---|
| OPERATION HOURS IN RECOVERY MODE | 15 | R4 | R4 | R4 | R4 | R3 | R1 | R1 |
| | 30 | R5 | R5 | R5 | R5 | R4 | R1 | R1 |
| | 45 | R5 | R5 | R5 | R5 | R5 | R3 | R2 |
| | 60 | R5 | R5 | R5 | R5 | R5 | R4 | R3 |
| AMOUNT OF TONER CONSUMED PER A4-SIZED SHEET (mm) | | 50 | 19 | 3 | 0.6 | 0 | 0 | 0 |
| | | | | ← SETTING RANGE → | | | | |

To obtain the data in Table 1, the present inventors used the image forming apparatus, bizhub C360 from Konica Minolta with modified charging rollers, to be described below. The detailed specifications of the image forming apparatus are as follows.

Total film thickness of photoreceptor drum 16: 25 μm

Film thickness of CGL 20: 2 μm

Film thickness of CTL 21: 20 μm

Film thickness of OCL 22: 3 μm

Potentials of VgA to VgD(Vdc): −600V

Frequencies of V11 and V12: 1.2 kHz (sine wave)

Potential of Vb: −450V

The evaluation method is as follows. First, the image forming apparatus was run to print character patterns with 5% image density in a continuous mode for about one hour. After completion of the printing, the inventors set the running time for the recovery mode, turned off the image forming apparatus, and left the image forming apparatus for 14 hours. After a lapse of 14 hours, the inventors turned the power back on to cause the image forming apparatus to execute the recovery mode. After the recovery mode, the inventors ran the image forming apparatus to print full-page halftone images (dotted images with 25% image density), and ranked the prints for image deletion by their image densities. The ranks are defined as follows.

Rank 5 (R5): no problem

Rank 4 (R4): slightly lighter image but no problem for practical use

Rank 3 (R3) or less: problem for practical use

According to Table 1, when the peak-to-peak voltage value Vpp for the alternating voltages V11 and V12 was set to Vknee or less, the rank for image deletion was improved. It can be appreciated that, particularly in the range of from −700V to −1100V, the rank for image deletion was good even if the running time in the recovery mode was short.

Furthermore, the bottom panel of Table 1 shows the amounts of toner consumed during the recovery mode for corresponding peak-to-peak voltage values Vpp. Specifically, the consumption amount of toner is indicated per A4-sized sheet. It can be appreciated that, as indicated at the bottom panel of Table 1, when Vpp was less than the lower limit (absolute value) of the setting range, the consumption amount of toner increased extremely. Inversely, by setting Vpp within the setting range, the image forming apparatus can create high-quality prints free of image deletion in the recovery mode executed for a short period of time, without consuming toner wastefully.

Figure 7:
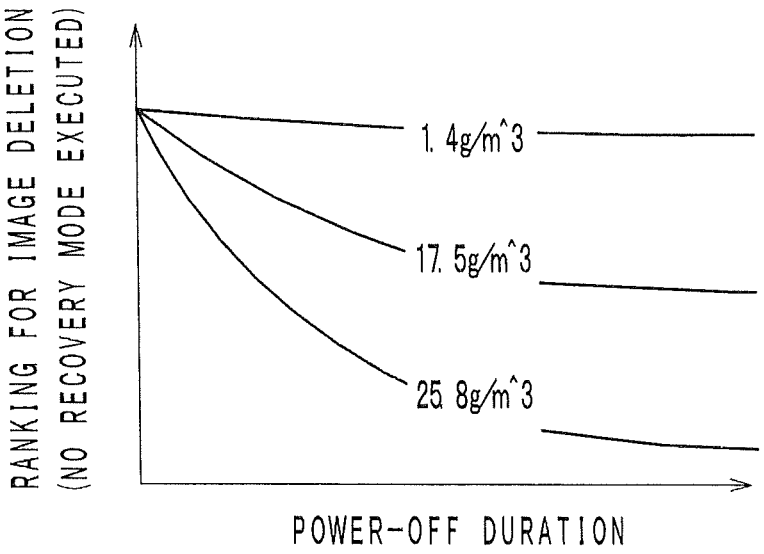
FIG. 7 is a graph showing the ranking for image deletion versus power-off duration of the image forming apparatus for each absolute humidity condition.

Incidentally, image deletion occurs when the surface of the photoreceptor drum becomes less resistant due to a discharge product adhering thereto, as described above. Such a state of low resistance occurs due to moisture in the air adsorbing onto the deteriorated surface of the photoreceptor drum 16. That is, image deletion is greatly affected by absolute humidity, which is the water content of air. For example, the absolute humidity is 25.8 g/m$^3$ at 30° C. with the relative humidity at 85%. Moreover, the absolute humidity is 17.5 g/m$^3$ at 23° C. with the relative humidity at 85%. In this manner, even if the relative humidity is the same, the absolute humidity is higher at a higher temperature. Accordingly, the degree of image deletion is worse at 30° C. with the relative humidity at 85% than at 23° C. with the relative humidity at 85%. Moreover, it takes a certain period of time until moisture in the air adsorbs onto the photoreceptor drum 16. Accordingly, even if the image forming apparatus is left in a high-temperature, high-humidity environment, the degree of image deletion is not worsened significantly in a short period of time, as shown in FIG. 7. In addition, when the image forming apparatus is left for some long period of time, once the amount of moisture adsorbing onto the photoreceptor drum 16 reaches a certain level, the degree of image deletion does not change thereafter even if the image forming apparatus is kept in the same environment. Therefore, in the above evaluation, the image forming apparatus was left for 14 hours.

Supplementary

The above embodiment uses the second charging bias voltage SV, which is obtained by superimposing an alternating voltage on a direct voltage. However, this is not restrictive, and a second charging bias voltage SV composed solely of a direct voltage may be used so long as the condition that no positive discharge onto the photoreceptor drum occurs is satisfied.

Although the present invention has been described in connect ion with the preferred embodiment above, it is to be noted that various changes and modifications are possible to those who are skilled in the art. Such changes and modifications are to be understood as being within the scope of the invention.

What is claimed is:

1. An image forming apparatus comprising:

a photoreceptor drum having a protective layer formed on its surface;

a charging bias supply circuit configured to generate a first charging bias voltage at the time of printing;

a charging unit configured to, upon application of the first charging bias voltage, cause a proximity discharge, including a positive discharge and a negative discharge, between the surface of the photoreceptor drum and the charging unit, thereby charging the surface;

a scanning optical system configured to irradiate the surface of the photoreceptor drum with an optical beam, thereby forming an electrostatic latent image, at the time of printing;

a developing unit configured to develop the electrostatic latent image formed on the photoreceptor drum, at the time of printing;

a control circuit configured to determine whether to execute a recovery mode based on temperature, humidity, or a combination thereof; and a cleaning unit configured to rub the surface of the photoreceptor drum charged by the charging unit, at the time of printing, wherein, the charging bias supply circuit is configured to generate a second charging bias voltage that causes no positive discharge between the charging unit and the photoreceptor drum, during the recovery mode, the charging unit is configured to charge the surface of the photoreceptor drum upon application of the second charging bias voltage during the recovery mode, and the cleaning unit is configured to rub the surface of the photoreceptor drum charged by the second charging bias voltage, during the recovery mode.

2. The image forming apparatus according to claim 1, wherein the first and second charging bias voltages are generated by superimposing alternating voltages on direct voltages.

3. The image apparatus according to claim 2, wherein a peak-to-peak voltage value for the superimposed alternating voltage in the second charging bias voltage is between 800V and 1100V.

4. The image apparatus according to claim 2, wherein the peak-to-peak voltage value for the superimposed alternating voltage in the second charging bias voltage is less than Vknee, wherein Vknee is a minimum peak-to-peak voltage value at which a surface potential of the photoreceptor drum is saturated.

5. The image forming apparatus according to claim 1, wherein, the photoreceptor drum further includes a charge transporting layer, and the protective layer is curable resin with a cross-linked structure formed on the charge transporting layer, and at least contains a particulate metal oxide.

6. The image forming apparatus according to claim 1, further comprising a temperature sensor that outputs a temperature value, and a humidity sensor that outputs a humidity value, wherein the control circuit determines to execute the recovery mode if the temperature value is above a predetermined temperature value and the humidity value is above a predetermined humidity value.

7. An image forming apparatus comprising:

a photoreceptor drum having a protective layer formed on its surface;

a charging bias supply circuit configured to generate a first charging bias voltage at the time of printing;

a charging unit configured to, upon application of the first charging bias voltage, cause a proximity discharge, including a positive discharge and a negative discharge, between the surface of the photoreceptor drum and the charging unit, thereby charging the surface;

a scanning optical system configured to irradiate the surface of the photoreceptor drum with an optical beam, thereby forming an electrostatic latent image, at the time of printing;

a developing unit configured to develop the electrostatic latent image formed on the photoreceptor drum, at the time of printing; and a cleaning unit configured to rub the surface of the photoreceptor drum charged by the charging unit, at the time of printing, wherein, the charging bias supply circuit is configured to generate a second charging bias voltage that causes no positive discharge between the charging unit and the photoreceptor drum, during a recovery mode, the charging unit is configured to charge the surface of the photoreceptor drum upon application of the second charging bias voltage during the recovery mode, and the cleaning unit is configured to rub the surface of the photoreceptor drum charged by the second charging bias voltage, during the recovery mode, wherein the first and second charging bias voltages are generated by superimposing alternating voltages on direct voltages, and a developing bias power circuit configured to, at the times of printing, generate a developing bias voltage, at least including a direct voltage, and apply the developing bias voltage to the developing unit, wherein, the following relationship is satisfied:

$$|V\text{knee}-2\cdot(|Vg|-|Vb|)|<Vpp\leq|V\text{knee}|,$$

where Vpp is a peak-to-peak voltage value for the superimposed alternating voltage in the second charging bias voltage, Vknee is a minimum peak-to-peak voltage value at which a surface potential of the photoreceptor drum is saturated, Vg is a direct voltage applied to charging unit during execution of the recovery mode, and Vb is a direct voltage applied to the developing unit during execution of the recovery mode.

* * * * *